US011266289B2

(12) United States Patent
Rigobert et al.

(10) Patent No.: US 11,266,289 B2
(45) Date of Patent: Mar. 8, 2022

(54) AUTOMATIC WASHING MACHINE AND METHOD

(71) Applicant: Reckitt Benckiser (Brands) Limited, Slough (GB)

(72) Inventors: Caroline Rigobert, Heidelberg (DE); Boris Seitz, Heidelberg (DE); Karl-Heinz Mohrhard, Heidelberg (DE); Frank Dierkes, Heidelberg (DE); Karlheinz Ulrich G. Hahn, Heidelberg (DE); Jorg Pflug, Heidelberg (DE); Judith Preuschen, Heidelberg (DE); Pavlinka Roy, Heidelberg (DE); Marco Haag, Heidelberg (DE); Dietmar Van Loyen, Heidelberg (DE); Stuart Campbell, Heidelberg (DE); Helmut Lunz, Heidelberg (DE)

(73) Assignee: RECKITT BENCKISER (BRANDS) LIMITED, Slough (GB)

( * ) Notice: Subject to any disclaimer, the term of this patent is extended or adjusted under 35 U.S.C. 154(b) by 117 days.

(21) Appl. No.: 15/500,512

(22) PCT Filed: Aug. 5, 2015

(86) PCT No.: PCT/GB2015/052267
§ 371 (c)(1),
(2) Date: Jan. 30, 2017

(87) PCT Pub. No.: WO2016/020680
PCT Pub. Date: Feb. 11, 2016

(65) Prior Publication Data

US 2017/0215689 A1 Aug. 3, 2017

(30) Foreign Application Priority Data

Aug. 5, 2014 (GB) ..... 1413859

(51) Int. Cl.
*A47L 15/02* (2006.01)
*A47L 15/00* (2006.01)
*A47L 15/44* (2006.01)

(52) U.S. Cl.
CPC ..... *A47L 15/0055* (2013.01); *A47L 15/0005* (2013.01); *A47L 15/0007* (2013.01); *A47L 15/4472* (2013.01); *A47L 2601/20* (2013.01)

(58) Field of Classification Search
CPC ..... A47L 2601/20
See application file for complete search history.

(56) References Cited

U.S. PATENT DOCUMENTS 3,969,134 A * 7/1976 Batka ..... C11D 1/722 134/26
4,259,201 A 3/1981 Cockrell, Jr. et al.
(Continued)

FOREIGN PATENT DOCUMENTS

DE 4219620 A1 * 12/1993 ..... A47L 15/44
EP 0062523 A2 10/1982
(Continued)

OTHER PUBLICATIONS

International Search Report and Written Opinion of the International Searching Authority for International Patent Application No. PCT/GB2015/052267 dated Oct. 8, 2015.
(Continued)

*Primary Examiner* — Mikhail Kornakov
*Assistant Examiner* — Ryan L Coleman
(74) *Attorney, Agent, or Firm* — Troutman Pepper Hamilton Sanders LLP; Ryan Schneider; Chris N. Davis

(57) ABSTRACT

The invention relates to a method of automatic dishwashing of dishware using wash water, in which, in a first step, a first composition, which comprises an oxygen bleach but substantially no enzyme, is supplied to the wash water, and the
(Continued)

Profile of the wash cycle of the invention dishware is washed in a washing zone with the oxygen bleach-containing wash water; and, in a second step which occurs after the first step, a second composition, which comprises an enzyme but substantially no bleach, is supplied to the wash water, and the dishware is washed in said washing zone with the enzyme-containing wash water. The invention also relates to an automatic dishwasher and a cartridge suitable for use in this method.

15 Claims, 3 Drawing Sheets

(56) References Cited

U.S. PATENT DOCUMENTS

| | | | | |
|---|---|---|---|---|
| 4,818,425 | A | 4/1989 | Meijer et al. | |
| 5,308,532 | A | 5/1994 | Adler et al. | |
| 5,807,438 | A * | 9/1998 | Lansbergen | A47L 15/0055 134/25.2 |
| 5,977,053 | A | 11/1999 | Groth et al. | |
| 6,426,229 | B1 | 7/2002 | Yamamoto et al. | |
| 2006/0219262 | A1* | 10/2006 | Peterson | A47L 15/4244 134/18 |
| 2009/0314313 | A1 | 12/2009 | Classen et al. | |
| 2010/0163076 | A1* | 7/2010 | Zipfel | C11D 3/39 134/25.2 |
| 2010/0212700 | A1 | 8/2010 | Wattley et al. | |
| 2011/0000511 | A1 | 1/2011 | Mersch et al. | |
| 2011/0262318 | A1* | 10/2011 | Hofte | C11D 17/041 422/272 |
| 2012/0214723 | A1* | 8/2012 | Bastigkeit | C11D 3/3932 510/220 |
| 2015/0097472 | A1* | 4/2015 | Rockwell | A47L 15/4209 312/228 |

FOREIGN PATENT DOCUMENTS

| | | | |
|---|---|---|---|
| EP | 0624154 | A1 | 11/1994 |
| EP | 0723006 | * | 7/1996 |
| EP | 1741774 | A1 | 1/2007 |
| EP | 2380481 | A2 | 10/2011 |
| EP | 2746456 | A1 | 6/2014 |
| GB | 1586769 | A | 3/1981 |
| GB | 2143231 | A | 2/1985 |
| WO | 94/26859 | A1 | 11/1994 |
| WO | 94/26860 | A1 | 11/1994 |
| WO | 95/01416 | A1 | 1/1995 |
| WO | 96/16152 | A1 | 5/1996 |
| WO | 02/092751 | A2 | 11/2002 |
| WO | 2005/090541 | A1 | 9/2005 |
| WO | 2010/043854 | A1 | 4/2010 |

OTHER PUBLICATIONS

Combined Search and Examination Report for United Kingdom Patent Application No. GB1413859.8 dated Feb. 3, 2015.

* cited by examiner

AUTOMATIC WASHING MACHINE AND METHOD

BACKGROUND

Automatic cleaning machines have been present in homes and commercial premises for decades. They offer genuine benefits in terms of speed of cleaning, consistency of cleaning and convenience with respect to manual cleaning.

The cost of automatic cleaning versus manual cleaning has been an important factor in the spread of automatic cleaning machines. An automatic cleaning machine has upfront costs associated with the purchase price and installation of the device, and then on-going costs associated with their use, including energy source (normally mains electricity), water supply and the required cleaning chemistry. These combined costs have led to the relative prevalence of automatic cleaning machines in developed markets whilst preventing their adoption in less developed markets.

Automatic cleaning machines come in many forms, including laundry cleaning machines and automatic dishwashing machines, both of which may be domestic or commercial/institutional machine types. Generally the differences are in terms of size and volume of throughput. This can mean the machines are designed in very different ways. Industrial/institutional machines often have much shorter but more energy intensive (e.g. higher temperature) cycles compared to domestic machines, and/or use much more aggressive chemistry (e.g. very highly alkaline detergent). Typically, they will not use enzymes, because these need a certain contact time with the treated soils to perform effectively, and the commercial cycle time is too short. In the case of dishwashers, the machines can be based on a conveyor system in which dishware is moved through a single or multiple tanks of the dishwasher, whereas in domestic machines the dishware will generally always remain stationary in one tank inside the dishwasher, and all the washing steps will occur in that single tank.

Especially in domestic dishwashing, it is conventional to include bleaches and enzymes in the detergent. These ingredients can interact adversely with one another, however. Previous approaches to solving this problem include providing one or both of these ingredients with a coating, or providing them in different compartments of a detergent capsule, thereby keeping them separate in the detergent during storage. The whole detergent/capsule is supplied to the wash at the same time, but the detergent/capsule may be configured to release different ingredients sequentially, for example via coatings dissolving at different times, or the film materials of the capsule compartments dissolving at different times. These arrangements can be rather complex to execute.

Another known approach is to store bleach and enzymes in separate sources, and dose them into the wash at different times from those different sources. Typically, though, bleach can destroy enzymes but not vice versa, so in the past, when bleach and enzymes have been dosed separately, the enzymes would tend to be dosed first, so these can perform their function before being deactivated by the bleach which is introduced later in the cycle. Use of a bleach scavenger has also been considered essential in some instances.

For example, US 2012/0214723 discloses an embodiment of a cartridge which doses three separate liquid bleach-, bleach activator-, and enzyme-containing compositions at different times into the wash of a single-tank domestic dishwasher, but preferably the enzyme-containing composition is dosed at least 1 minute before the bleach activator-containing one, and at least 2 minutes before the bleach-containing one. Similarly, US 2011/0000511 discusses releasing an enzyme-based detergent followed by a chlorine-based detergent in sequential periods of the main wash of a single-tank domestic dishwasher from, for instance, the dispenser located in the dishwasher door. The enzymatic wash period is at a lower temperature. Enzymes are also dosed before bleach in US 2009/0314313, in a wash program which is over two hours long in total. In US 2010/0212700, the bleach is preferably released last, in the rinse cycle. WO 02/092751 provides an example of a capsule releasing enzyme before bleach, preferably before halogen bleach (but at the same time as oxygen bleach).

WO 96/16152 discloses the dosing of bleach before enzyme, but this is in the context of a commercial multi-tank/conveyor type machine in which the bleach and enzyme are introduced into different wash zones from each other. The temperatures and durations of the individual washing steps are not disclosed. On the other hand, EP 2,380,481 discloses a multi-dosing device which doses halogen bleach at least 3 minutes before dosing enzymes, but a bleach scavenger must be used together with the enzyme-containing composition. Both compositions may be introduced into the main wash at the same temperature.

Improvements to cleaning machines in recent years have reduced the on-going costs associated with use. Energy efficiency has been improved through development of lower temperature cycles, and water use has been reduced. There is a need in the art to further reduce automatic machine cleaning costs, whilst at the same time improving cleaning performance. It would also be advantageous to reduce the overall cycle time of domestic machines without a corresponding increase in energy consumption or decrease in performance, and preferably without using harsher detergents or more costly detergents.

The present inventors have found that it is possible to dose an oxygen bleach before the enzyme(s), within the same tank, without significantly impairing the performance of the enzyme(s), even when no bleach scavenger is used. By use of the improved wash cycle described herein, it is possible to achieve a dramatic reduction in the overall cycle time of domestic dishwashers, reduce water and energy usage in the machine, and also simplify and reduce costs of the detergent.

SUMMARY OF THE INVENTION

According to a first aspect of the invention, there is provided a method of automatic dishwashing of dishware using wash water comprising: in a first step, supplying a first composition, which comprises an oxygen bleach substantially free of enzyme, to wash water, and washing the dishware in a washing zone with the oxygen bleach-containing wash water; and in a second step which occurs after the first step, supplying a second composition, which comprises an enzyme substantially free of bleach, to the wash water, and washing the dishware in the washing zone with the enzyme-containing wash water.

According to a second aspect of the invention, there is provided an automatic dishwasher configured to carry out any of the methods described herein.

According to a third aspect of the invention, there is provided a cartridge for use in any of the methods described herein, wherein the cartridge encloses the first composition and the second composition, and the first composition is isolated from the second composition, wherein the cartridge is adapted to allow, in response to a signal, the first composition to be released from the cartridge before the second composition is released from the cartridge.

According to a fourth aspect of the invention, there is provided an automatic dishwasher configured to carry out any of the methods described herein and that is programmed to cooperate with any of the cartridges described herein in order to carry out those methods.

According to a fifth aspect of the invention, there is provided a method of automatically cleaning soiled items in an automatic cleaning machine, comprising the following cycle of steps carried out in any order:

A. An optional rinse step comprising wash water;
B. At least one bleaching step wherein at least one bleaching treatment composition is dosed into the wash water;
C. An optional rinse step comprising wash water;
D. At least one enzymatic step wherein the wash water is maintained between 10° C. and 65° C. and at least one enzyme treatment composition is dosed into the wash water;
E. An optional rinse step comprising wash water;
F. At least one rinse and shine step wherein at least one rinse treatment composition is dosed into the wash water, optionally deionised wash water; and
G. An optional heated drying step, to remove water.

According to a sixth aspect of the invention, there is provided an automatic washing machine capable of independently dosing at least one bleach treatment composition, at least one enzyme treatment composition and at least one rinse treatment composition by the method according to the invention in its fifth aspect.

DETAILED DESCRIPTION

Figure 1:
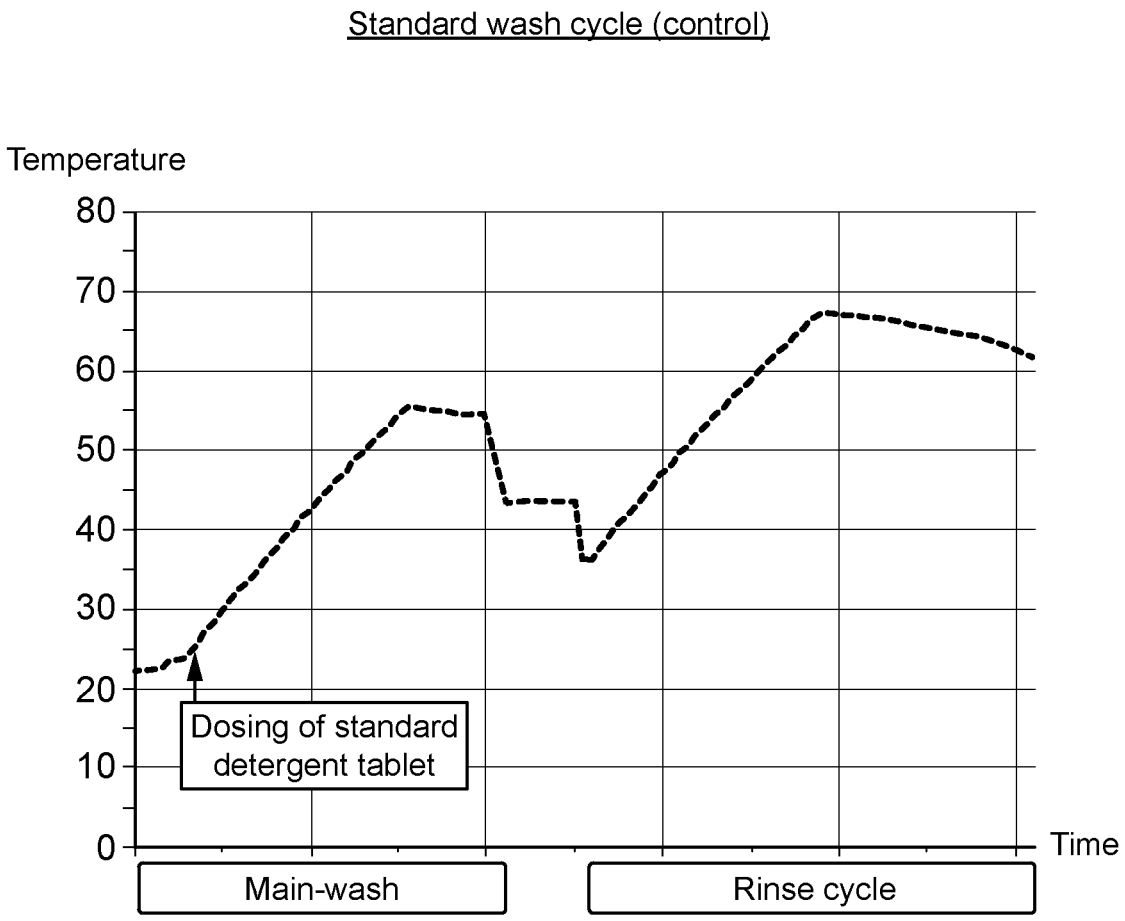
Prior Art Fig. 1
FIG. 1 illustrates the temperature profile of a prior art wash program in a domestic automatic dishwasher, and the point at which the detergent is dosed.

Unless specifically stated or the context otherwise requires, embodiments described herein apply equally to all aspects of the invention. Percentages quoted are by weight, unless otherwise stated or the context otherwise requires.

Recent machine developments to improve the efficiency and costs of running an automatic dishwasher have stalled. The inventors believe that this is because the machine manufacturers feel limited to design their new machines with reference to standard detergent solutions for dishwashing, whereas the manufacturers of automatic dishwashing (ADW) detergent compositions tend to develop their formulations using standard machines and present machine wash cycle parameters. To break the stalemate, a whole new wash process is envisaged to allow improvements in both machine and chemistry, to advance cleaning performance and efficiency whilst saving costs.

The invention particularly applies to dishwashers having a single tank and/or non-conveyor type machines, in which the machine does not transport the dishware through a wash zone.

Currently available detergents for automatic dishwashers are designed for use in the standardised process used by most dishwashers on the market. The cleaning process in current European domestic dishwashers is generally the following:

1) An optional initial cool rinse cycle.
2) Main wash cycle (add main detergent chemistry)
3) Rinse step (optional addition of further rinse chemistry)
4) Drying The current best machines use 6-10 L of water per wash cycle.

The inventors believe that further improvements in machine efficiency coupled with cleaning improvements can only be achieved through an optimisation of the chemistry, in conjunction with machine development.

Currently, the cleaning chemistry comprises a combination of potentially conflicting ingredients that would require different optimal conditions, and the current use allows only for a best approximation of these conditions when all of the cleaning chemistry (with the exception of rinse aids) is dosed together. The inventors have found an alternative cleaning method that provides equivalent or superior cleaning, potentially utilising less energy and/or water and/or chemicals. This is achieved through separate dosing of ingredients at their own optimal conditions.

In the first aspect of the invention, the first composition comprising oxygen bleach but substantially no enzyme, and the second composition comprises enzyme but substantially no bleach (whether oxygen bleach, halogen bleach or any other type of bleach). Preferably, the first composition contains no more than 0.1 wt % enzymes, preferably no more than 0.01 wt % enzymes, preferably no more than 0.001 wt % enzymes, preferably no more than 0.0001 wt % enzymes, preferably no more than trace amounts of enzymes, preferably no enzymes. Preferably, the second composition contains no more than 2 wt % bleach, preferably no more than 1 wt % bleach, preferably no more than 0.5 wt % bleach, preferably no more than 0.1 wt % bleach, preferably no more than trace amounts of bleach, preferably no bleach.

In this method, the oxygen bleach-containing composition is dosed before the enzyme-containing composition. Although it is possible to use an oxygen bleach scavenger in the enzyme-containing composition (or in a step in between dosing of the first and second compositions), this is not essential. The first step may be at a temperature and for a duration sufficient to ensure that at least substantially all of the bleach is consumed during the first step. Preferred embodiments are set out in the claims. Alternatively or in addition, the wash water may be removed from the interior of the dishwasher and fresh wash water used in the second step. If required, water may be recycled in between first and second steps, e.g. passing it through a filter and/or subjecting it to treatment outside the main tank to minimise carry-over of any remaining unreacted bleach. Furthermore, it is possible to use a rinse step in between the first and second steps, which ensures that any remaining unreacted bleach is rinsed away from the dishware.

The second step can also be optimised for enzyme performance, given that substantially no bleach is present. Preferred embodiments of temperature, duration etc. are set out in the claims.

In the invention in its fifth aspect, the machine may be any type of automated cleaning machine. These include laundry and textile cleaning machines, hard surface cleaning machines and dishwashing machines. In one preferred embodiment, the machine is an automatic dishwashing machine.

Embodiments of the invention in its fifth aspect are as recited in claims 16-40. To the extent that they relate to automatic dishwashing methods in which oxygen bleach is dosed before the enzyme, there are analogous embodiments of the invention in its first aspect.

The following wash cycle method has been found by the inventors to be highly desirable for optimum cleaning and energy saving performance in a dishwasher:

A. An optional rinse step comprising wash water;

B. At least one bleaching step wherein at least one bleaching treatment composition is dosed into the wash water;

C. An optional rinse step comprising wash water;

D. At least one enzymatic step wherein the wash water is maintained between 10° C. and 65° C. and at least one enzyme treatment composition is dosed into the wash water;

E. An optional rinse step comprising wash water;

F. At least one rinse and shine step wherein at least one rinse treatment composition is dosed into the wash water, optionally deionised wash water; and G. An optional heated drying cycle, to remove water.

The method steps may be carried out in any order. In a preferred embodiment, they are carried out in order from A to G in an automatic dishwashing machine. All steps A, C, E and G are optional rinsing and drying steps. These may be omitted individually or entirely as required. In particular, if energy saving is paramount then a heating drying step G can be avoided altogether, to allow for ambient drying. The wash cycle may comprise only steps B, D and F.

The steps are not limited to discrete steps with complete separate inflows and outflows of water to the machine. There may be overlap in terms of the wash water. For example, if performed in order of step B, step D and then step F, the wash water in the machine may not change completely or in temperature between steps. The addition of the composition of step D may be the only change to mark the transition. Alternatively, a complete wash water change may be undertaken prior to beginning the next step.

In another, less preferred embodiment, the steps are carried out in the following order: A, D, C, B, E, F, G.

For the purposes of the present invention, the term deionised water may mean distilled water or deionised water. It may also mean water purified by reverse osmosis, carbon filtration, microfiltration, ultrafiltration, ultraviolet oxidation, or electrodialysis. Preferably, the conductivity of the deionised water of the present invention is below 100 μSm at 25° C.; more preferably, the deionised water has a conductivity below 50 μSm, more preferably below 30 μSm and most preferably below 10 μSm.

Heating of the wash water for steps of the method, if required, may occur within the machine itself with internal heaters, or be provided from an external source, or a combination of the two.

Measurements of the quantity of water used per step herein refers to the quantity of water in the hydraulic system for that step of the cleaning cycle.

The individual steps of the wash method are described in more detail below.

A—Optional Rinse Step

This may utilise water alone, or the wash water may contain active ingredients. Nevertheless, it is preferred that this step uses a composition consisting of water. The water may be of any hardness level. The wash water may be deionised water.

If one of the optional cycles is selected and step A is the first step, then it may be used simply to mechanically (or hydraulically) loosen soil from kitchen or tableware in advance of further cleaning steps.

Any amount of wash water may be used in the rinse step. It is preferred, however, that less than 2.5 L of water is used, more preferably less than 1.5 L, more preferably less than 1.0 L and most preferably less than 0.5 L for this rinse step.

The initial rinse step may take place at ambient temperature or may be carried out at elevated temperature. It is preferred that the rinse step be carried out at ambient temperature.

B—Bleaching Step.

During this step, at least one bleaching treatment composition is released into the machine wash liquor. It is preferable that this is carried out at elevated temperature. The heated wash step may preferably be carried out above 30° C., preferably above 40° C., more preferably above 50° C. and most preferably above 60° C. Nevertheless, the bleaching step may be carried out at ambient temperatures if more active species are used, such as hydrogen peroxide or sodium perchlorate. Ambient temperature herein means from about 5° C. to about 25° C.

Preferably, the at least one bleaching composition is released at the beginning of the bleach washing step. Any conventional bleaching compound can be used, in any conventional amount, in the bleach compositions. There may also be more than one bleaching compound in the bleach compositions; a combination of different bleaching compounds may be used in each bleaching treatment composition.

The bleach compound is normally hydrogen peroxide or a hydrogen peroxide precursor, such as for example a percarbonate, as a hydrogen peroxide source. Most preferably the bleach is selected from inorganic peroxy-compounds and organic peracids and salts thereof. Examples of inorganic perhydrates include persulfates such as peroxymonopersulfate (KMPS), perborates or percarbonates. The inorganic perhydrates are normally alkali metal salts, such as lithium, sodium or potassium salts, in particular sodium salts. The inorganic perhydrates may be present in the detergent as crystalline solids without further protection. For certain perhydrates, it is advantageous to use them as granular compositions provided with a coating, which gives the granular products a longer shelf life.

The preferred percarbonate is sodium percarbonate of the formula $2Na_2CO_3.3H_2O_2$. A percarbonate, when present, is preferably used in a coated form to increase its stability.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

In the fifth aspect of the invention, the bleaching compound may also be a chlorine based bleach compound, or precursor such as sodium or calcium hypochlorite. Chlorine bleach works much more effectively at ambient temperatures, needing no activation or catalysis. This makes chlorine bleach suitable for low temperature washing. However, some chlorine bleaches give rise to handling and safety concerns associated with the potential release of chlorine gas.

The bleach-containing composition may further comprise a bleach activator and optionally bleach catalyst to improve performance. These components are particularly used to boost the performance of oxygen based bleach at lower temperatures. By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in GB 1,586,769 and GB 2,143,231, and a method for their formation into a prilled form is described in EP 0,062,523.

Suitable examples of such compounds to be used herein are tetracetylethylenediamine (TAED), sodium-3,5,5-trimethylhexanoyloxybenzenesulphonate, diperoxydodecanoic acid (as described for instance in U.S. Pat. No. 4,818,425) and nonylamide of peroxyadipic acid (as described for instance in U.S. Pat. No. 4,259,201) and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam, pentanoyl caprolactam, or mixtures thereof. A particular family of bleach activators of interest was disclosed in EP 0,624,154, and particularly preferred in that family is acetyltriethylcitrate (ATC). Acetyl triethyl citrate has the advantage that it is environmental-friendly, as it eventually degrades into citric acid and alcohol. Furthermore, acetyltriethylcitrate has a good hydrolytical stability in the product upon storage, and it is an efficient bleach activator. Finally, it provides good building capacity to the composition.

Any suitable bleach catalyst may be used, for example manganese acetate or dinuclear manganese complexes such as those described in EP 1,741,774. The organic peracids such as perbenzoic acid and peroxycarboxylic acids, e.g. PAP, do not require the use of a bleach activator or catalyst as these bleaches are active at relatively low temperatures such as about 30° C., and this contributes to such bleach materials being especially preferred according to the present invention.

The bleach composition may further comprise a builder, co-builder, a source of alkalinity and a wetting agent or surfactant.

Bleach performance is known to be highly affected by water hardness: the softer the water, the better the bleach performance. Not wishing to be limited by theory, it is proposed that heavy metal ions and calcium and magnesium ions deactivate active oxygen or chlorine species. In a preferred embodiment, the water of the wash step is less than 9 degrees of German water hardness, preferably less than 6 degrees and most preferably less than 3 degrees of German hardness. In one preferred embodiment, the water used in the bleaching step is deionised water. The deionised water will have a hardness of less than 1 degree of German hardness.

The bleach composition may take any form known in the art. It may be provided in an inert carrier. In one preferred embodiment, it may be in liquid form for each of metered dosing, with preferably the inert carrier being a liquid. In a further preferred embodiment, the inert carrier of the bleaching treatment composition is deionised water.

Preferably the pH of the wash water of the bleaching step is between 8 and 12, preferably between 9 and 11. Preferably the amount of wash water used for the beaching step is less than 2.5 L, preferably less than 1.5 L, more preferably less than 1 L and most preferably less than or equal to 0.5 L per step.

The bleaching step is preferably is carried out for less than 30 mins. More preferably, it is carried out for less than 20 mins, most preferably for less than 10 mins. The bleaching step is preferably carried out for at least 1 min, preferably 2 mins, more preferably 2.5 mins and most preferably at least 3 mins.

Optionally a surfactant-containing composition may also be released into the wash liquor during step B. Preferably, the surfactant-containing composition may be released at the end of the cycle.

C—Optional Rinse Step.

This is similar to step A and may have some or all of the features described above.

In addition, if the preferred method cycle is followed, and step C follows step B, a chemical treatment may be utilised to destroy any remaining unreacted bleach present in the machine prior to further steps. The chemical treatment may comprise metal salts. Metal salts are known to interact with bleach precursors to disable them. A particularly preferred chemical treatment for step C is a zinc salt, such as zinc sulphate. Other sources of metal ions may be used.

Metal salts can also provide a material care benefit. Zinc, in particular, is known to help prevent glassware corrosion.

D—Enzyme Wash Step.

The wash liquor is preferably maintained between 20° C. and 50° C., more preferably between 32° C. and 45° C. degrees and most preferably between 37° C. and 43° C. degrees. This step is designed to provide optimum working conditions for enzyme treatment, and at least one enzyme treatment composition may be added during this cycle.

It is preferred that the enzyme is selected from proteases, lipases, amylases, cellulases and peroxidases, with proteases and amylases, especially proteases being most preferred. It is most preferred that protease and/or amylase enzymes are included in the compositions according to the invention, as such enzymes are especially effective for example in dishwashing detergent compositions. Any suitable species of these enzymes may be used as desired. More than one species may be used.

The warm wash cycle may take between 5 and 90 mins, preferably between 10 and 75 mins, preferably between 10 and 60 mins and most preferably between 15 and 30 mins.

Total amounts of active enzyme utilised may be between 1 mg and 1500 mg, preferably between 10 mg and 1000 mg, more preferably between 25 mg and 500 mg and most preferably between 50 mg and 250 mg.

The enzyme cycle may be carried out in softened or deionised water. However enzymes are known to be tolerant of harder water conditions, and this may not be required.

Preferably the at least one enzyme composition comprises a source of alkalinity and/or a buffer. Preferably the pH of the enzyme step is maintained between 8-12, more preferably between 9-11 and most preferably between 10-11.

E—Optional Rinse Step

This is similar to step A and may have some or all of the features described above.

If the preferred sequence is carried out and this step follows D, this step may allow for removal of enzyme residues and comprise a mixture of water and further chemical treatment.

This rinse step may be carried out with wash liquor alone.

F—Rinse (and Shine) Step

In this step at least one rinse treatment composition is dosed into the wash water.

The rinse (and shine) cycle may be carried out using deionised water. This is advantageous over even softened water, as there are no ionic species present in the wash water that can deposit over the cleaned tableware. This leads to a reduction in filming and spotting. Deionised water during the rinse step is therefore highly preferred.

In a particular embodiment, the rinse cycle may consist only of deionised water, wherein the rinse treatment composition comprises only deionised water. Alternatively, the at least one rinse treatment composition may comprise at least one surfactant and/or at least one polymer and/or at least one acid. The rinse treatment composition may additionally comprise an inert carrier. It is preferred that the inert carrier is deionised water.

The pH of the rinse and shine step is preferably between 4 and 8, more preferably between 5 and 7 and most preferably between 5.5 and 6.5.

The at least one rinse composition may comprise one or more surfactants. The surfactant may comprise a non-ionic, anionic, cationic, amphoteric or zwitterionic surface active agent, or suitable mixtures thereof may be used. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred according to the present invention.

Non-ionic surfactants are especially preferred according to the present invention, especially for automatic dishwashing compositions. For laundry and cleaning applications (excluding automatic dishwashing), other surfactants such as anionic surfactants are preferably included and suitable types are well known in the art.

A preferred class of nonionic surfactants are alkoxylated non-ionic surfactants prepared by the reaction of a monohydroxy alkanol or alkylphenol with 6 to 20 carbon atoms. Preferably, the surfactants have at least 12 moles, particularly preferred at least 16 moles, and still more preferred at least 20 moles, such as at least 25 moles of ethylene oxide per mole of alcohol or alkylphenol. Particularly preferred non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of non-ionic surfactant can be described by the formula:

$$R^1O[CH_2CH(CH_3)O]_x[CH_2CH_2O]_y[CH_2CH(OH)R^2]$$

wherein $R^1$ represents a linear or branched chain aliphatic hydrocarbon group with 4-18 carbon atoms or mixtures thereof, $R^2$ represents a linear or branched chain aliphatic hydrocarbon group with 2-26 carbon atoms or mixtures thereof, x is a value between 0.5 and 1.5, and y is a value of at least 15.

Another group of preferred non-ionic surfactants are the end-capped polyoxyalkylated non-ionics of formula:

$$R^1O[CH_2CH(R^3)O]_x[CH_2]_kCH(OH)[CH_2]_jOR^2$$

wherein $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2, each $R^3$ in the formula above can be different. $R^1$ and $R^2$ are preferably linear or branched chain, saturated or unsaturated, aliphatic or aromatic hydrocarbon groups with 6-22 carbon atoms, wherein groups with 8 to 18 carbon atoms are particularly preferred. For the group $R^3$, H, methyl or ethyl is particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1, resulting in compounds of the simplified formula:

$$R^1O[CH_2CH(R_3)O]_xCH_2CH(OH)CH_2OR^2.$$

The use of mixtures of different nonionic surfactants is suitable in the context of the present invention, for instance mixtures of alkoxylated alcohols and hydroxy-group containing alkoxylated alcohols. Other suitable surfactants are disclosed in WO 95/01416, to the contents of which express reference is hereby made.

Preferably the non-ionic surfactants are present in the rinse treatment composition in an amount from 10 mg to 10,000 mg, preferably from 50 mg to 7,500 mg, preferably from 75 mg to 1,000 mg, most preferably between 100 mg to 500 mg.

A builder may also be included, and it may be either a phosphorous-containing builder or a phosphorous-free builder as desired. The rinse treatment composition may comprise further optional ingredients. The rinse treatment composition may have a source of acidity and a builder composition. The source of acidity may be an organic carboxylic acid. A preferred example is citric acid and salts thereof.

An example rinse treatment composition of the present invention comprises deionised water, citric acid, and a non-ionic surfactant such as Plurafac LF 300. Alternatively, the rinse treatment composition may consist of only deionised water.

G—Optional Heated Drying Step.

This may be avoided entirely to save energy. Drying may simply be carried out at ambient temperature. If the preferred cycle is used, the temperature of the rinse and shine step may determine whether a heated drying step is required. Should more rapid drying be required, the final step in the complete wash cycle may be a heated drying step G. This may be equivalent to drying cycles known in the art and machines currently on the market.

The drying step may be carried out at greater than 30° C., preferably greater than 40° C., more preferably greater than 50° C. and most preferably greater than 60° C. It may last between 1 and 60 minutes, preferably between 5 and 45 mins, more preferably between 10 and 40 mins and most preferably between 20 and 30 mins.

As an alternative, a vibration drying system may be used. This may achieve drying through the rapid mechanical motion of the items to be dried. This aids the removal of water droplets from the items to be dried.

Chemical drying aids may be used, for example zeolites or carbon nano-tubes as described in EP 2,746,456.

Optional Ingredients of the Treatment Compositions

A builder may also be included in any of the compositions described herein, and it may be either a phosphorous-containing builder or a phosphorous-free builder as desired. The builder may be the same for all of the compositions, or different builders may be used for each composition.

If phosphorous-containing builders are also to be used, it is preferred that mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP). Conventional amounts of the phosphorous-containing builders may be used in each composition. Preferably, if used, between 10 mg and 10,000 mg of phosphate builder may be included per composition, more preferably between 50 and 5000 mg, more preferably between 100 and 2500 mg and most preferably between 250 and 1500 mg per composition.

If a phosphorous-free builder is included, it is preferably chosen from amino acid based compounds and/or succinate based compounds. The terms 'succinate based compound' and 'succinic acid based compound' are used interchangeably herein. Conventional amounts of the amino acid based compound and/or succinate based compound may be used per composition of the present method. Preferably, between 10 mg and 10,000 mg of non-phosphate builder may be used per composition, more preferably between 50 and 5000 mg, more preferably between 100 and 2500 mg and most preferably between 250 and 1500 mg per composition.

Preferred examples of amino acid based compounds which may be used are MGDA (methyl-glycine-diacetic acid, and salts and derivatives thereof) and GLDA (glutamic-N,N-diacetic acid and salts and derivatives thereof).

Other suitable builders are described in U.S. Pat. No. 6,426,229, which are incorporated by reference herein. Particular suitable builders include, for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula

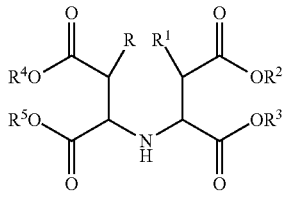

in which: R and $R^1$, independently of one another, denote H or OH; and $R^2$, $R^3$, $R^4$, and $R^5$, independently of one another, denote a cation, hydrogen, alkali metal ion or ammonium ion, said ammonium ion having the general formula $R^6R^2R^8R^9N^+$, wherein $R^6$, $R^2$, $R^8$, and $R^9$, independently of one another, denote hydrogen, an alkyl radical having 1 to 12 C atoms, or a hydroxyl-substituted alkyl radical having 2 to 3 C atoms.

Preferred examples include tetrasodium imminosuccinate. Iminodisuccinic acid (IDS) and (hydroxy)iminodisuccinic acid (HIDS), and alkali metal salts or ammonium salts thereof, are especially preferred succinate based builder salts.

It is especially preferred according to the present invention that the builder comprises methyl-glycine-diacetic acid, glutamic-N,N-diacetic acid, tetrasodium imminosuccinate, or (hydroxy)iminodisuccinic acid, or a salt or derivative thereof.

Another preferred builder is a malonyl lactate derivative, e.g. as described in WO 2010/043854.

The phosphorous-free builder may also or alternatively comprise non-polymeric organic molecules with carboxylic group(s). Builder compounds which are organic molecules containing carboxylic groups include citric acid, fumaric acid, tartaric acid, maleic acid, lactic acid and salts thereof. In particular, the alkali or alkaline earth metal salts of these organic compounds may be used, and especially the sodium salts. An especially preferred phosphorous-free builder is sodium citrate. Such polycarboxylates which comprise two carboxyl groups include, for example, water-soluble salts of malonic acid, (ethylenedioxy)diacetic acid, maleic acid, diglycolic acid, tartaric acid, tartronic acid and fumaric acid. Such polycarboxylates which contain three carboxyl groups include, for example, water-soluble citrate. Correspondingly, a suitable hydroxycarboxylic acid is, for example, citric acid.

Preferably, the total amount of builder present is an amount of at least 20 wt %, and most preferably at least 25 wt %, preferably in an amount of up to 70 wt %, preferably up to 65 wt %, more preferably up to 60 wt % of the compositions. The actual amount used in the compositions will depend upon the nature of the builder used. If desired, a combination of phosphorous-containing and phosphorous-free builders may be used.

The compositions of the present method may optionally further comprise a secondary builder (or co-builder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts are the sodium salts. Secondary builders which are organic are preferred. A polymeric polycarboxylic acid is the homopolymer of acrylic acid. Other suitable secondary builders are disclosed in WO 95/01416, to the contents of which express reference is hereby made.

Preferably the total amount of co-builder present is an amount of up to 2000 mg, preferably at least 500 mg per composition. The actual amount used in the compositions will depend upon the nature of the builder used.

In some preferred embodiments, the treatment compositions further comprise one or more further chelating agents. The further chelating agents are preferably selected from 1-hydroxyethylidene-1,1-diphosphonic acid (HEDP), ethylenediaminedisuccinic acid (EDDS), ethylenediaminetetraacetic acid (EDTA), diethylenetriaminepentaacetic acid (DTPA), diethylenetriaminepentamethylenephosphonic acid (DTPMPA), nitrilotriacetic acid (NTA), aspartic acid diethoxysuccinic acid (AES), aspartic acid-N,N-diacetic acid (ASDA), ethylenediamine tetra methylene phosphonic acid (EDTMP), iminodifumaric acid (IDF), iminoditartaric acid (IDT), iminodimaleic acid (IDMAL), iminodimalic acid (IDM), ethylenediaminedifumaric acid (EDDF), ethylenediaminedimalic acid (EDDM), ethylenediamineditartaric acid (EDDT), ethylenediaminedimaleic acid (EDDMAL), and aminotri(methylenephosphonic acid) (ATMP); and salts and mixtures thereof.

Where any chelating agent described herein is present as a salt, it may be present as a metal salt, for example an alkali metal salt, or it may be present as an ammonium or quaternary ammonium salt. Suitable metal salts include salts of potassium, sodium, boron, magnesium, zinc or a mixture thereof. Especially preferred are sodium salts. Suitable ammonium salts include salts of ammonia and ethanolamine.

In some preferred embodiments, the composition of the present invention comprises less than 20 wt % phosphonate chelating agents, preferably less than 15 wt %, preferably less than 12 wt %, more preferably less than 10 wt %, suitably less than 8 wt %, for example less than 7 wt % or less than 6 wt %.

By phosphonate chelating agents we mean to include compounds derived from substituted phosphonic acids. Such compounds are known to the person skilled in the art and include, for example 1-hydroxyethylidene-1,1-diphosphonic acid (HEDP), diethylenetriaminepentamethylenephosphonic acid (DTPMPA), aminotri(methylenephosphonic acid) (ATMP) and ethylenediaminetetramethylenephosphonic acid (EDTMP).

The compositions of the present method may also comprise a source of acidity or a source of alkalinity, to obtain the desired pH, on dissolution, especially if the composition is to be used in an automatic dishwashing application. Preferred silicates are sodium silicates, such as sodium disilicate, sodium metasilicate and crystalline phyllosilicates. A source of acidity may suitably be any suitable acidic compound, for example a polycarboxylic acid. For example a source of alkalinity may be a carbonate or bicarbonate (such as the alkali metal or alkaline earth metal salts). A source of alkalinity may suitably be any suitable basic compound, for example any salt of a strong base and a weak acid. When an alkaline composition is desired, silicates are amongst the suitable sources of alkalinity.

The compositions of the present method may comprise one or more anti-corrosion agents, especially when the detergent compositions are for use in automatic dishwashing operations. These anti-corrosion agents may provide benefits against corrosion of glass and/or metal, and the term encompasses agents that are intended to prevent or reduce the tarnishing of non-ferrous metals, in particular of silver and copper.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, bismuth, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, zinc acetate, zinc sulphate and $Ce(NO_3)_3$. Any suitable source of multivalent ions may be used, with the source preferably being chosen from sulphates, carbonates, acetates, gluconates and metal-protein compounds. Zinc salts are especially preferred corrosion inhibitors.

Other glassware protection agents are cationic polymers. A particularly preferred polymer is PEI, or polyethyleneimine.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included in the compositions of the present method. However, it is preferred that they are present in a total amount of from 1 mg to 5000 mg, preferably 5 mg to 1000 mg, more preferably 10 to 750 mg and most preferably 20 mg to 500 mg.

Polymers intended to improve the cleaning performance of the detergent compositions may also be included therein. For example, sulphonated polymers may be used. Preferred examples include copolymers of $CH_2{=}CR^1{-}CR^2R^3{-}O{-}C_4H_3R^4{-}SO_3X$ (wherein $R^1$, $R^2$, $R^3$, $R^4$ are independently 1 to 6 C alkyl or hydrogen, and X is hydrogen or alkali) with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy) propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethylmethacrylamide and water soluble salts thereof.

Suitable sulphonated polymers are also described in U.S. Pat. No. 5,308,532 and in WO 2005/090541. When a sulfonated polymer is present, it is preferably present in an amount of at least 50 mg, preferably at least 100 mg, more preferably at least 200 mg, and most preferably at least 300 mg. When a sulfonated polymer is present, it is preferably present in an amount up to 5 g, preferably up to 2.5 g, more preferably up to 1.5 g, and most preferably up to 1 g.

The compositions used in the present invention may also comprise one or more foam control agents. Suitable foam control agents for this purpose are all those conventionally used in this field, such as, for example, silicones and their derivatives and paraffin oil. The foam control agents are preferably present in amounts of less than 250 mg per composition.

The compositions used in the present invention may also comprise minor, conventional, amounts of preservatives, dyes, fragrances etc.

Cleaning Cycle

The treatment compositions of the present invention may take any form, e.g. solid, liquid, gel, powder or mixtures thereof. Preferably, the treatment compositions will be in liquid form. Preferably the inert carrier is a liquid solvent. Most preferably the solvent is water. The water may be softened for the entire cleaning cycle, alternatively the water may be selectively softened for only the bleach and rinse steps. Preferably the water used is deionised water for one or both steps.

The method of the invention means that the overall cleaning cycle time (from A to G) may be as low as 40 minutes, preferably as low as 30 mins and most preferably as low as 20 mins.

The method may allow the user of the machine to target different stains by dialing up or down the quantities of the different treatment compositions used in a wash cycle.

If the machine has sensors, the method may allow the machine to determine the time of step length, quantity of treatment composition and temperature reached, based on the situation in the cleaning machine.

The treatment compositions of the invention may be provided in an inert carrier. For the purposes of the present invention an inert carrier is any medium within which the treatment composition can be dispersed that does not react with the composition. The inert carrier may take any form, e.g. solid, liquid, gel, powdered. Preferably the inert carrier is a liquid and more preferably a solvent and most preferably water. The water may be deionised.

Dishwashing Machine & Cartridge

Described herein is an automatic dishwasher designed to carry out the method of the first and fifth aspects of the invention. The automatic dishwasher of the present invention in its sixth aspect will have the ability to dose at least three different compositions at different time points during the wash cycle. It is preferable that the machine is capable of independently dosing four or more compositions.

It is preferable that the machine has multiple wash functions with different temperature settings, cycle lengths and water consumption and drying options. It is preferable that the machine offers cycles where steps D and B are inverted, such that step D occurs before step B in the wash cycle.

It is preferred that the machine may be able to independently control the amount of water used for each step of the cycle of the method of the first invention. It is preferable that the machine uses no more than 2.5 L, more preferably no more than 1.5 L, more preferably no more than 1 L of water and most preferably no more than 0.5 L for each step. The water for each step may be fresh, but preferably the water will be recycled between steps to reduce water consumption.

It is preferred that the machine provides both long wash cycles for highly soiled tableware and short wash cycles for lightly soiled tableware. It is preferred that the dishwasher contains settings for wash cycles with a temperature of at least 60° C., preferably at least 65° C. and most preferably at least 70° C. for the heated portion of the wash cycle. It is preferred that the machine provides drying options for a drying cycle, including temperature settings. It is also preferable that the drying step can be omitted to save energy.

It is preferable that the machine may come in standard dimensions for dishwashing machines. It may also be preferable for smaller versions be developed for certain markets and household sizes. Preferably the machine has a method of preparing deionised water. This may be by reverse osmosis.

The machines of the present invention preferably have the ability to dose formulations in different forms. Preferably the machines can dose powders, granules, tablets, water soluble pouches or capsules, gels and liquids or combinations thereof. It is preferable that the machine is designed to receive the different treatment compositions as a single cartridge. Thus, the machine may be simply refilled with all the chemistry it needs with a single operation. A "cartridge" is a non-water-soluble (e.g. plastic) holder for storing and releasing the compositions. In all aspects of the invention, it may connect physically to the machine and communicate electronically with it ("machine-dependent cartridge"), to release the various compositions at predefined points in the cycle in response to electrical or other signals from the machine. Thus, the cartridge may be configured to only work with the machine that it is designed to connect to. This distinguishes it from other cartridges which may be placed anywhere within the machine interior and which have to sense wash conditions directly (rather than taking their signals from the machine itself), in order to know when to release their compositions ("machine-independent cartridge").

Alternatively, the treatment compositions may be supplied in individual cartridges for dosing. This may prevent waste by only requiring replacement of exhausted cartridges rather than the entire cartridge when a single component within it is exhausted. The latter option is more appealing should the machine have settings to allow the user to select cycles that apply differing amounts of each treatment composition than for the standard cycle. A boost facility or extra shine facility may release extra bleach or rinse treatment compositions into the wash respectively.

It is also preferable that in addition to having simple programs, the automatic machine of the present invention may also have an automatic dosing (or metered dosing) control ability. This would allow the machine, based on sensory inputs, to increase or decrease the amount of chemicals added to each stage of the wash. The sensors may also be able to lengthen or shorten sequence steps, based on conditions. Sensors that may be used include pH, turbidity, temperature, humidity, conductivity etc. The machine may require data processing power to achieve this.

Drying could be monitored by a humidity sensor, such that drying (if required) would only be carried out for the duration that it was needed and no longer.

It is preferable that the machine will have connectivity to other devices. This may take the form of wi-fi, 3G mobile data, Bluetooth, etc. This may allow the machine to be monitored and/or controlled remotely. Preferably this also allows the machine to connect with the internet. This may also allow the machines to reorder new chemistry and/or cartridges and/or refills when required.

The invention is further described with reference to the following non-limiting Examples. Further examples within the scope of the invention will be apparent to the person skilled in the art.

EXAMPLES

The benefits of the method of the present invention are best shown in the experiments outlined below. A modified machine according to the present invention was tested alongside a standard single-tank domestic machine (Miele G651SC Plus, Normal 50 wash) using a standard dishwashing detergent monodose tablet. The chemistry included is detailed below. The invention is not limited by the chemistry demonstrated below.

Figure 2:
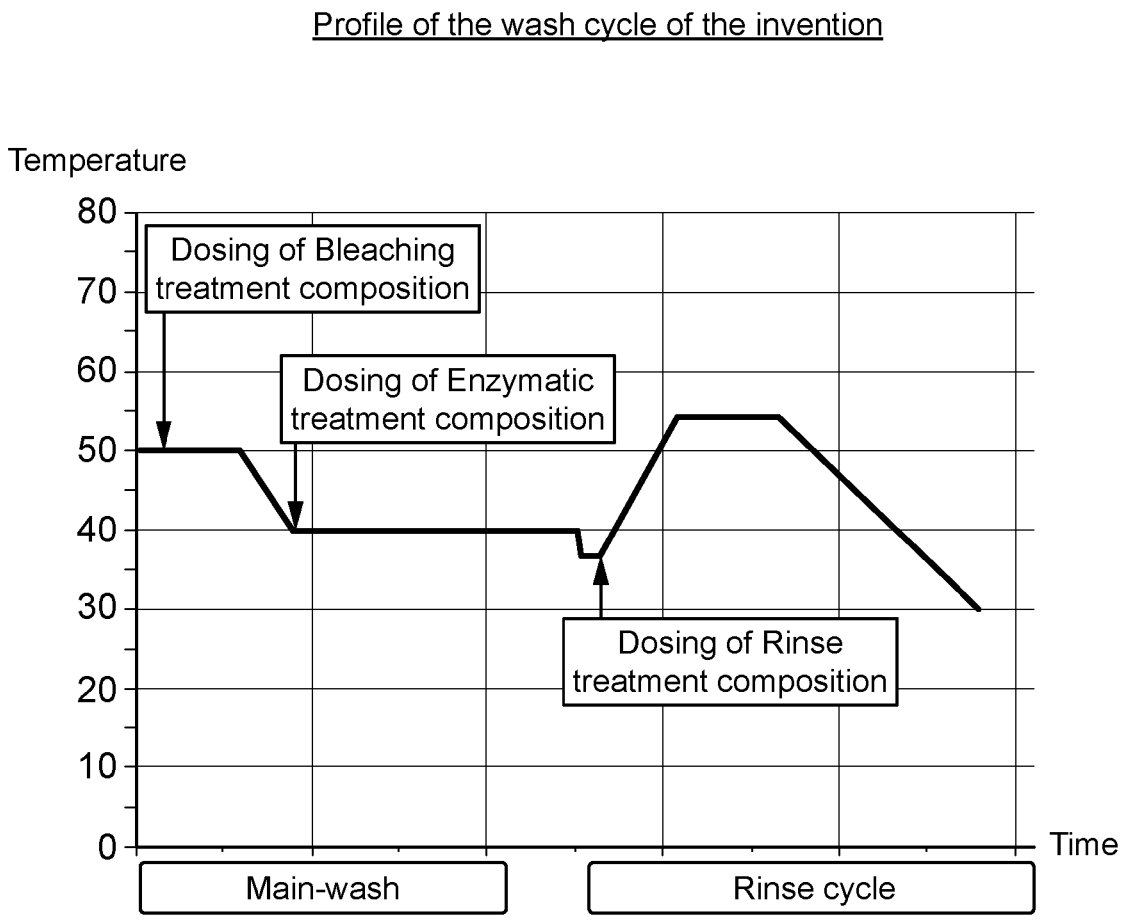
FIG. 2 illustrates the temperature profile of a wash program in a domestic automatic dishwasher in an embodiment of the invention, and the points at which the various detergent components are dosed.
Figure 3:
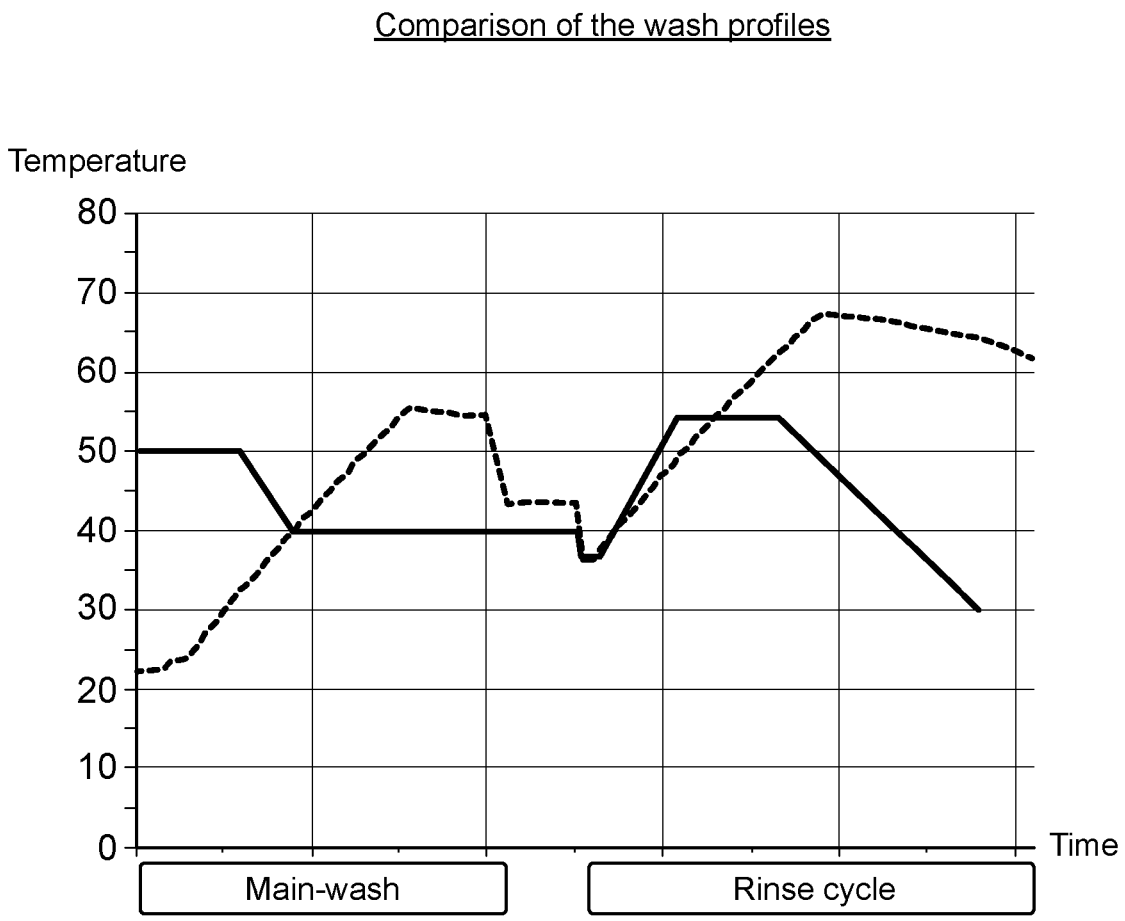
FIG. 3 overlays the profiles of FIGS. 1 and 2 for easy comparison.

To provide a fair control, the chemistry contained within the tablet was matched as closely as possible, in terms of quantities and ingredients in the method of the present invention. The cycle used (temperature/time) in the standard (control) machine (FIG. 1) and the modified machine utilising the method of the present invention are also shown (FIG. 2). These are also shown overlaid (FIG. 3), and the dosing points for the treatment compositions are also indicated.

The bleaching step was carried out for 3 minutes. The enzyme step was carried out for 15 minutes and the rinse and shine step for 5 minutes.

The method of the present invention followed the steps from A to G in order.

Water usage for the control machine under IKW conditions was 13.75 L per cycle. The method according to the present invention used 5.0 L of water per cycle. There is scope for reducing this further in the method of the present invention.

The method of the invention was already able to dispense with many components of the tablet completely. These ingredients included the fillers, binders and stabilisers that are need to ensure a working monodose detergent. This already provides for a saving to the consumer.

Water was used as an inert carrier for the treatment compositions of the present invention.

Tablet (control) - Ingredients

| Ingredient | Quantity (grams) |
|---|---|
| Bleach (percarbonate) | 2.75 |
| TAED | 0.3 |
| Bleach catalyst | 0.1 |
| Builder | 6.7 |
| Phosphonate | 0.75 |
| Polymers | 0.37 |
| Alkalinity source/buffer | 2.1 |

-continued

Tablet (control) - Ingredients

| Ingredient | Quantity (grams) |
|---|---|
| Binders | 1.0 |
| Enzymes (protease + amylase) | 0.3 |
| Non-ionic surfactant (Lutensol AT 25) | 0.6 |
| Other (dye/fillers/fragrance/additives) | 1.98 |
| Total | 16.95 grams |

Method of the Invention

Bleaching treatment composition

| Ingredient | Quantity (grams) |
|---|---|
| Bleach (percarbonate) | 2.75 |
| TAED | 0.3 |
| Bleach catalyst | 0.1 |
| Builder | 3.3 |
| Phosphonate | 0.75 |
| Alkalinity source/buffer | 2.4 |
| Total | 9.6 |

Enzyme treatment composition

| Ingredient | Quantity (grams) |
|---|---|
| Enzymes (amylase + protease) | 0.3 |
| Alkalinity source/buffer | 0.7 |
| Total | 1.0 |

Rinse treatment composition (using deionised water)

| Ingredient | Quantity (grams) |
|---|---|
| Non-ionic surfactant | 0.2 |
| Total | 0.2 |

Results

The results show that improvements on bleachable stains, enzyme treatable stains and rinse performance can already be seen using the standard chemistry in standard amounts. In fact, rinse performance was actually hampered in the new method using the same level of surfactant as found in the tablet. To obtain equivalent rinse performance, only one third as much surfactant was required.

Bleach Scores

Bleach performance was measured according to the IKW test. Stained teacups were prepared and tested in both test machines. Evaluation was conducted visually according to the IKW photo catalogue (a higher score is a better result, grading from 1 to 10):

Normal tablet in standard machine run gave results of 7.75

Method of the present invention provided score of 10.0.

Proteinaceous & Starch Stains (Enzyme Performance)

CFT plates stained with egg yolk and starch mix according to IKW were used to check performance. Removal of soil was determined by measuring the delta E (LAB system).

Measurements were made by colorimeter; the higher the score, the greater the cleaning.

Egg yolk:

Normal tablet in standard machine: 16.3

Method of the invention 25.4

Starch:

Normal tablet in standard machine: 28.6

Method of the invention 62.5

Filming and Spotting (Rinse Performance):

Improved filming and spotting results were seen in the method of the present invention versus the normal tablet, using only one third of the surfactant.

Follow Up Experiments

Bleaching performance was so good that repeat experiments were run without the inclusion of bleach catalyst. The bleach performance was maintained without catalyst.

The method of the present invention demonstrates excellent performance gains over the standard method with reduced chemistry and water use.

The invention claimed is:

1. A method of automatic dishwashing of dishware using wash water, the method consisting of:

a first step of supplying a first composition comprising an oxygen bleach substantially free of enzyme to wash water and washing the dishware in a washing zone with the oxygen bleach-containing wash water;

a second step of subsequently supplying a second composition comprising an enzyme substantially free of bleach to the wash water and washing the dishware in the washing zone with the enzyme-containing wash water, wherein the pH of the wash water in each of the first step and the second step is between 8 and 12, wherein the method is carried out in a domestic dishwashing machine, wherein the volume of wash water used in either of the first or second steps is no more than 3 L;

optionally supplying a third composition in a third step subsequent to the second step, the third composition comprising at least one rinse treatment composition;

optionally drying the dishware; and wherein there is an optional rinsing step with rinse water before the first step, between the first and second steps, and/or between the second and third steps, and wherein none of the first composition, second composition, and third composition comprises a bleach scavenger.

2. The method according to claim 1 further comprising a first rinsing step in between the first step and the second step, in which the dishware is rinsed with first rinsing water substantially free of oxygen bleach and the pH of the first rinsing water in the first rinsing step is between 4 and 8.

3. The method according to claim 1, wherein at least 80% by weight of the oxygen bleach in the first composition is consumed during the first step and/or not carried over in the wash water to the second step.

4. The method according to claim 1, wherein a temperature T1 at which the dishware is washed with the oxygen bleach-containing wash water in the first step is different from a temperature T2 at which the dishware is washed with the enzyme-containing wash water in the second step.

5. The method according to claim 1, wherein a maximum temperature of the wash water reached during the first step is in the range of between 30° C. and 70° C.

6. The method according to claim 1, wherein a maximum temperature of the wash water reached during the second step is in the range of between 10° C. and 65° C.

7. The method according to claim 1, wherein the first composition is supplied to the wash water at a time $t_1$ and the second composition is supplied to the wash water at a time $t_2$, wherein $t_2$ is in the range of between 1 minute and 15 minutes after $t_1$.

8. The method according to claim 1, wherein the combined length of the first and second steps is no more than 45 minutes.

9. The method according to claim 1, wherein the oxygen bleach is an inorganic perhydrate.

10. The method according to claim 1, wherein the first composition comprises a builder and a bleach activator.

11. The method according to claim 1 further comprising a first rinsing step in between the first step and the second step, in which the dishware is rinsed with wash water substantially free of active detergent ingredients.

12. The method according to claim 1, wherein at least 98% by weight of the oxygen bleach in the first composition is consumed during the first step and/or not carried over in the wash water to the second step.

13. The method according to claim 1, wherein a temperature $T_1$ at which the dishware is washed with the oxygen bleach-containing wash water in the first step is at least 10° C. greater than a temperature $T_2$ at which the dishware is washed with the enzyme-containing wash water in the second step.

14. The method according to claim 1, wherein the combined length of the first and second steps is no more than 20 minutes.

15. The method according to claim 1, wherein the oxygen bleach is a percarbonate; and wherein the volume of wash water used in either of the first or second steps is no more than 0.5 L.

* * * * *